US007677138B2

(12) United States Patent
Lin

(10) Patent No.: US 7,677,138 B2
(45) Date of Patent: Mar. 16, 2010

(54) RATCHET SCREWDRIVER

(76) Inventor: Chia-Yun Lin, No. 14, Lane 155, Sec. 3, Situn Rd., Situn Dist., Taichung (TW)

( * ) Notice: Subject to any disclaimer, the term of this patent is extended or adjusted under 35 U.S.C. 154(b) by 121 days.

(21) Appl. No.: 12/016,133

(22) Filed: Jan. 17, 2008

(65) Prior Publication Data

US 2009/0183605 A1 Jul. 23, 2009

(51) Int. Cl.
*B25B 13/46* (2006.01)

(52) U.S. Cl. ..... 81/63.2; 81/58.1

(58) Field of Classification Search ..... 81/58, 81/58.1, 60–63.2

See application file for complete search history.

(56) References Cited

U.S. PATENT DOCUMENTS 4,102,375 A * 7/1978 Rossini ..... 81/30
5,894,765 A * 4/1999 Anderson et al. ..... 81/60
7,520,198 B1 * 4/2009 Lin ..... 81/63

* cited by examiner

*Primary Examiner*—D. S Meislin
(74) *Attorney, Agent, or Firm*—Apex Juris, pllc; Tracy M Heims

(57) ABSTRACT

A ratchet screwdriver includes a handle, a ratchet, a shaft, a finger ring and a tool. The handle has a body having a receiving chamber and a front through hole. The receiving chamber is formed in the body and communicates with the front through hole. The ratchet is mounted securely in the receiving chamber and has a driving protrusion and a drive selector. The shaft is mounted rotatably in the body and has a proximal end mounted securely on the keyed driving protrusion. The finger ring is mounted securely around the shaft outside the body and is smaller than the handle to allow quick and easy rotation of the shaft. The tool is selectively mounted securely in the shaft.

6 Claims, 7 Drawing Sheets

RATCHET SCREWDRIVER

BACKGROUND OF THE INVENTION

1. Field of Invention

The present invention relates to a hand tool, and more particularly to a ratchet screwdriver that can be rotated quickly and easily.

2. Description of the Related Art

When a conventional ratchet screwdriver is turned to tighten or loosen a fastener, a handle of the conventional ratchet screwdriver is rotated in multiple positive turns with a ratchet disengaging during a negative turn and re-engaging for another positive turn.

Because during starting off tightening and finishing off loosening requires little torque, rotating the handle of the conventional ratchet screwdriver is laborious, time wasting, troublesome and causes discomfort to a user.

To overcome the shortcomings, the present invention provides a ratchet screwdriver to mitigate or obviate the aforementioned problems.

SUMMARY OF THE INVENTION

The primary objective of the present invention is to provide a ratchet screwdriver that can be turned quickly and easily.

The ratchet screwdriver in accordance with the present invention comprises a handle, a ratchet, a shaft, a finger ring and a tool.

The handle comprises a body having a front end, a rear end, an inner surface, a receiving chamber and a front through hole. The receiving chamber is defined in the body at the rear end. The front through hole is defined through the body and communicates with the receiving chamber.

The ratchet is mounted securely in the receiving chamber.

The shaft is mounted rotatably in the front through hole of the body and securely on the ratchet and has a proximal end and a distal end. The proximal end is connected to the ratchet. The distal end protrudes out from the front end of the body and has a keyed socket formed axially in the distal end and polygonal.

The finger ring is mounted securely around the distal end of the shaft and is smaller than the body to allow quick and easy rotation of the shaft without rotating the handle.

The tool is selectively mounted securely in the shaft and has a proximal end mounted in and corresponding to the keyed socket of the shaft and polygonal.

Other objectives, advantages and novel features of the invention will become more apparent from the following detailed description when taken in conjunction with the accompanying drawings.

DETAILED DESCRIPTION OF THE INVENTION

Figure 1:
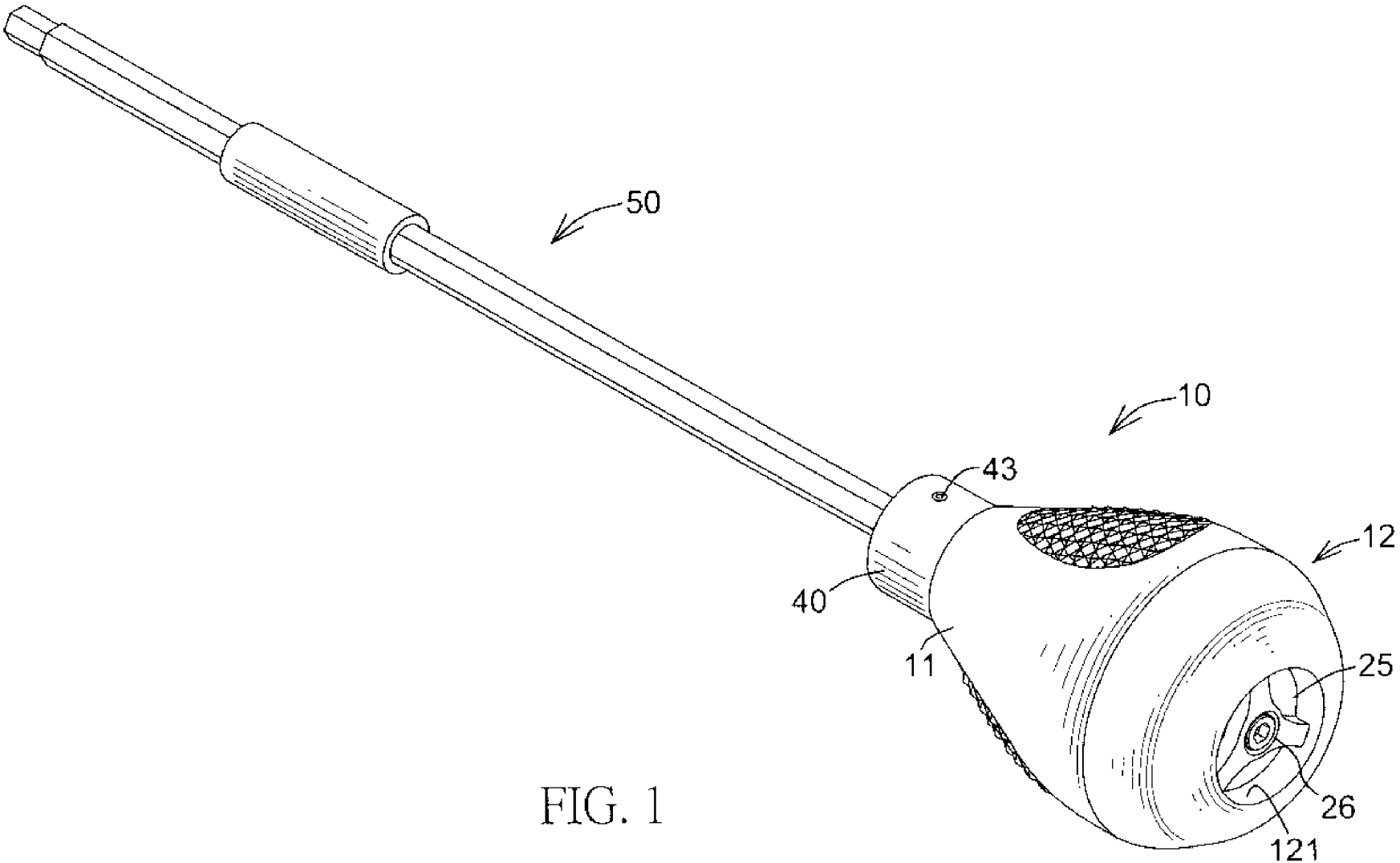
FIG. 1 is a perspective view of a ratchet screwdriver in accordance with the present invention.
Figure 2:
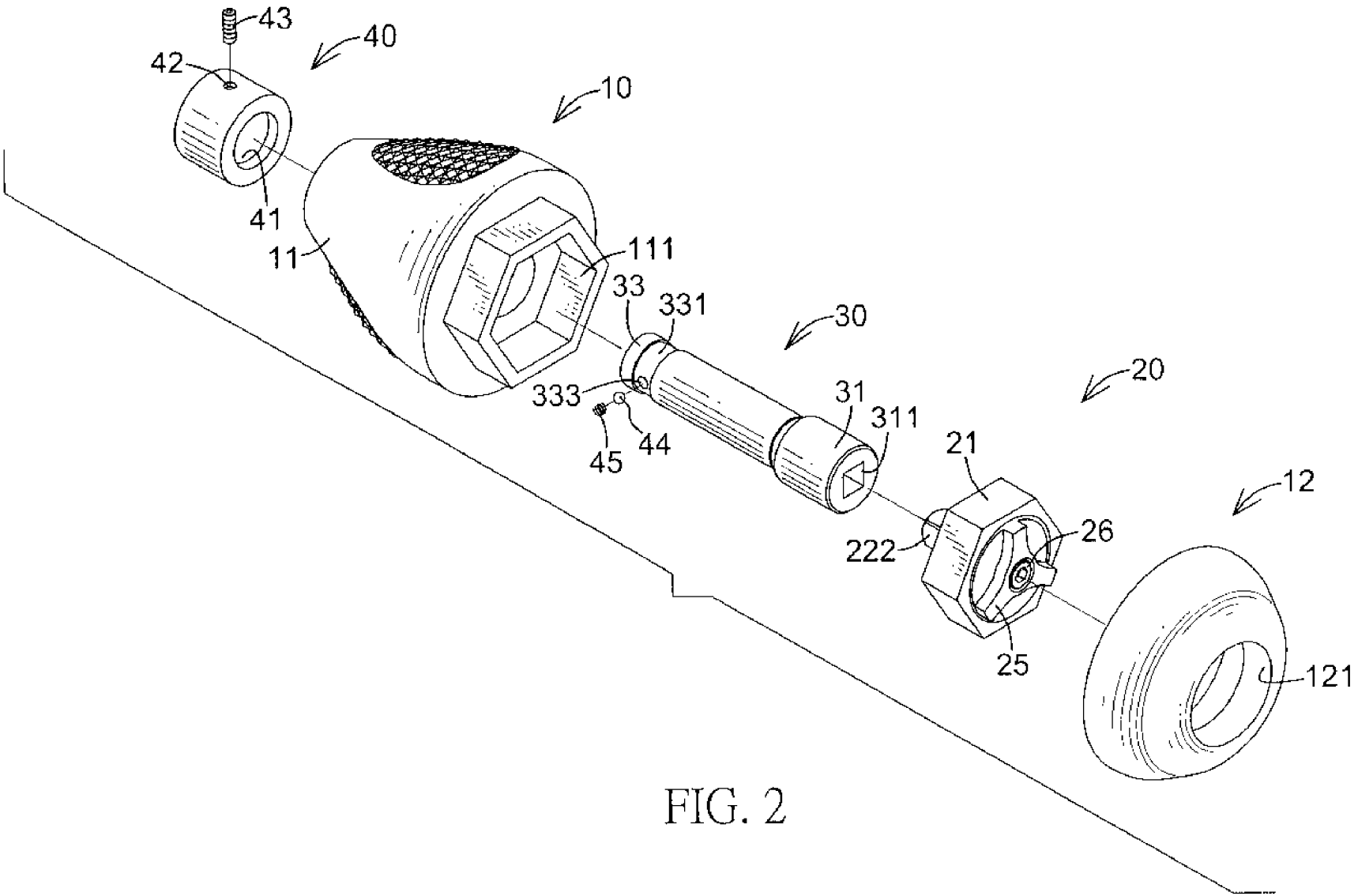
FIG. 2 is an exploded perspective view of the ratchet screwdriver in FIG. 1.
Figure 3A:
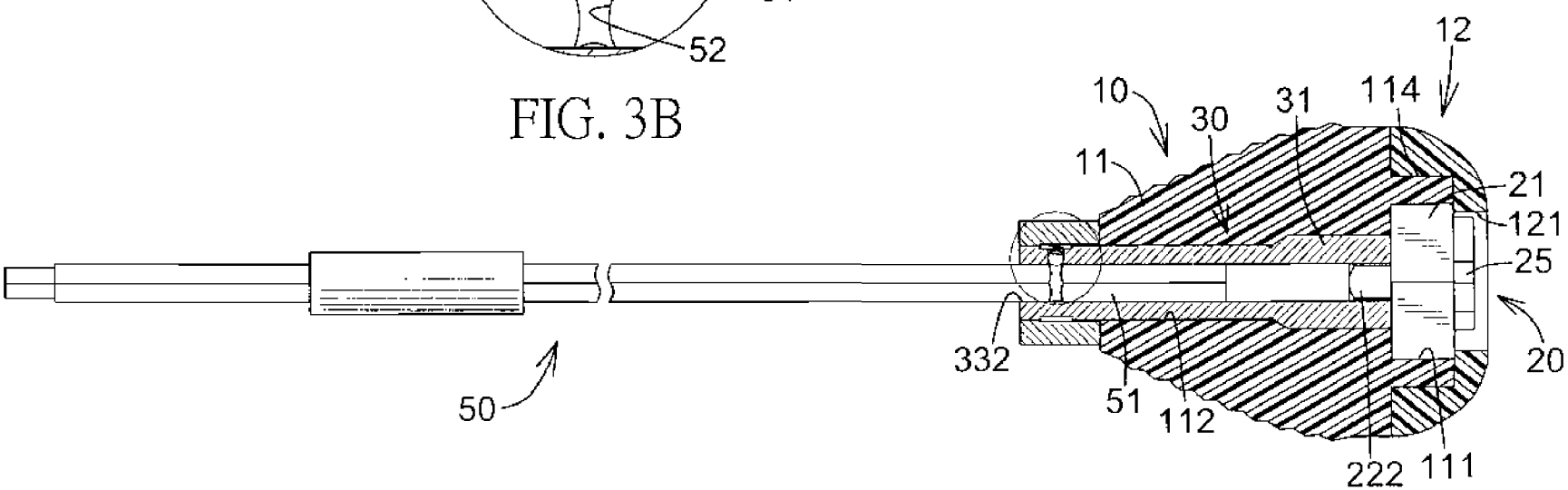
FIG. 3A is a side view in partial cross section of the ratchet screwdriver in FIG. 1.
Figure 3B:
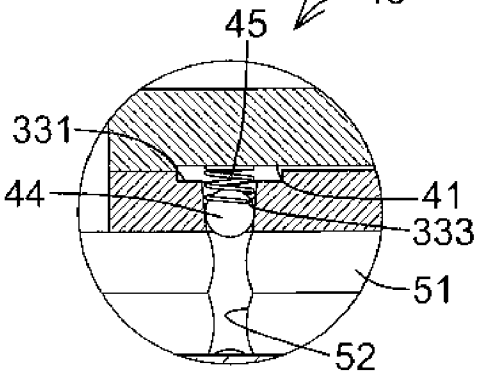
FIG. 3B is an enlarged side view in partial section of the ratchet screwdriver in FIG. 3A.

With reference to FIGS. 1 to 3B, a ratchet screwdriver in accordance with the present invention comprises a handle (10), a ratchet (20), a shaft (30), a finger ring (40) and a tool (50).

The handle (10) comprises a body (11) and a cap (12). The body (11) has a front end, a rear end, an inner surface, a receiving chamber (111), a front through hole (112) and a mounting lip (114). The receiving chamber (111) is defined in the body (11) at the rear end and may be hexagonal or polygonal. The front through hole (112) is defined through the front end of the body (11) and communicates with the receiving chamber (111). The mounting lip (114) is smaller than, is formed on and protrudes axially from the rear end of the body (11) around the receiving chamber (111). The cap (12) is mounted on the mounting lip (114) of the body (11) and has a rear through hole (121) defined through the cap (12) and communicating with the receiving chamber (111).

Figures 4A, 4B:
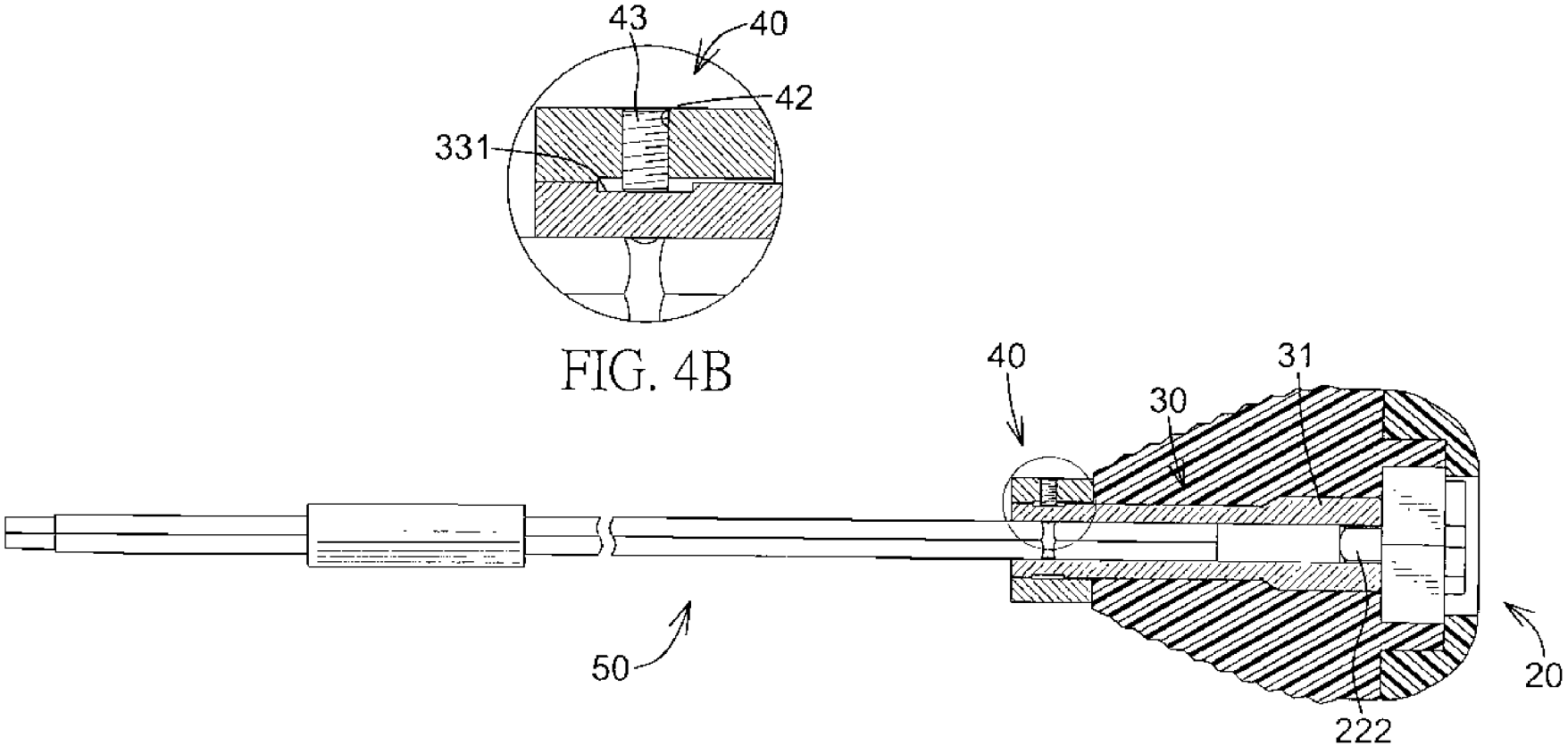
FIG. 4A is another side view in partial cross section of the ratchet screwdriver in FIG. 1.
FIG. 4B is an enlarged side view in partial section of the ratchet screwdriver in FIG. 4A.
Figure 5:
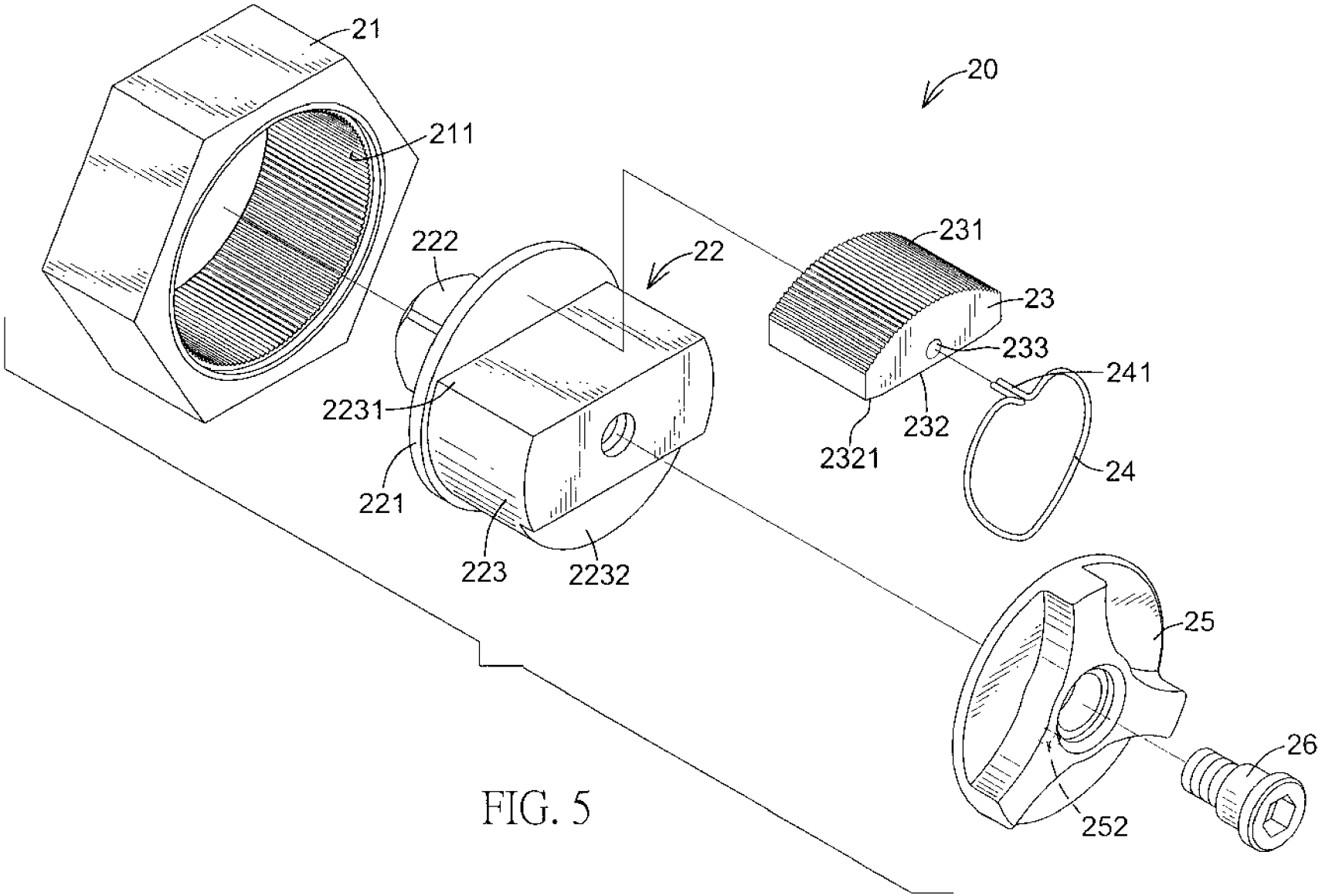
FIG. 5 is an exploded perspective view of a ratchet of the ratchet screwdriver in FIG. 1.
Figure 6:
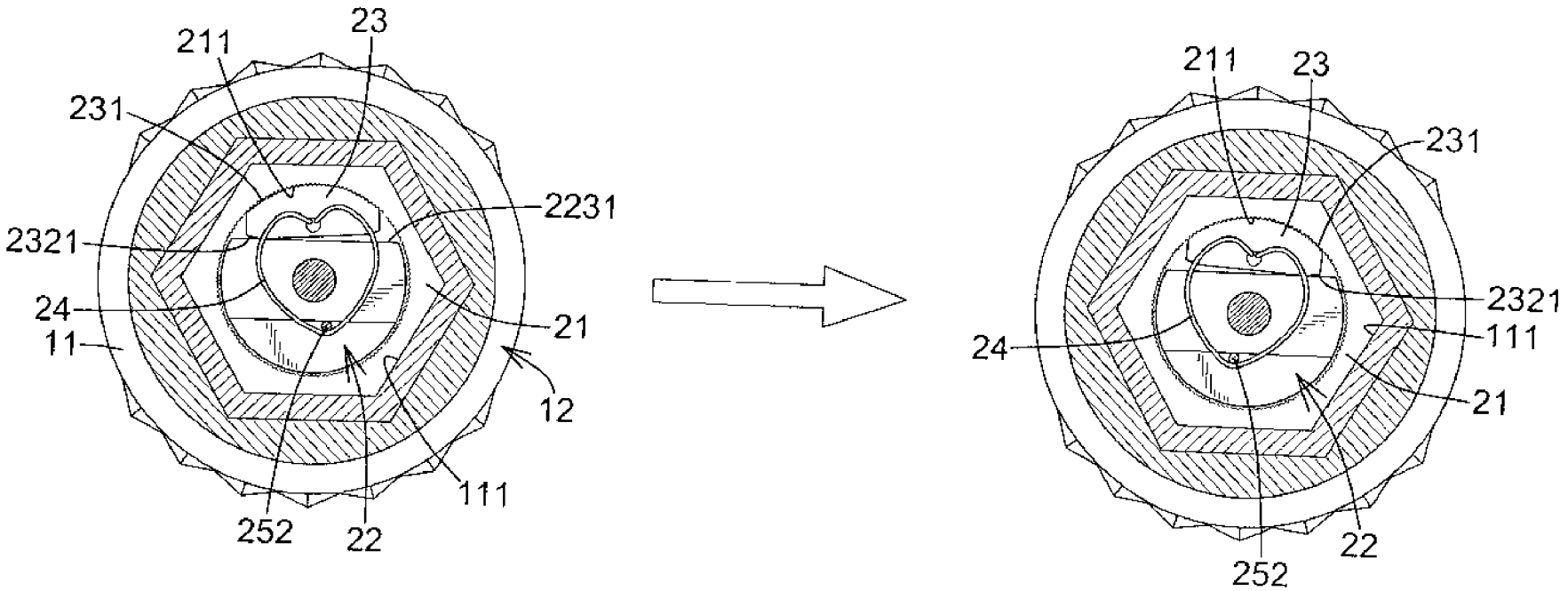
FIG. 6 is an operational rear view in partial cross section of the ratchet screwdriver in FIG. 1.
Figure 7:
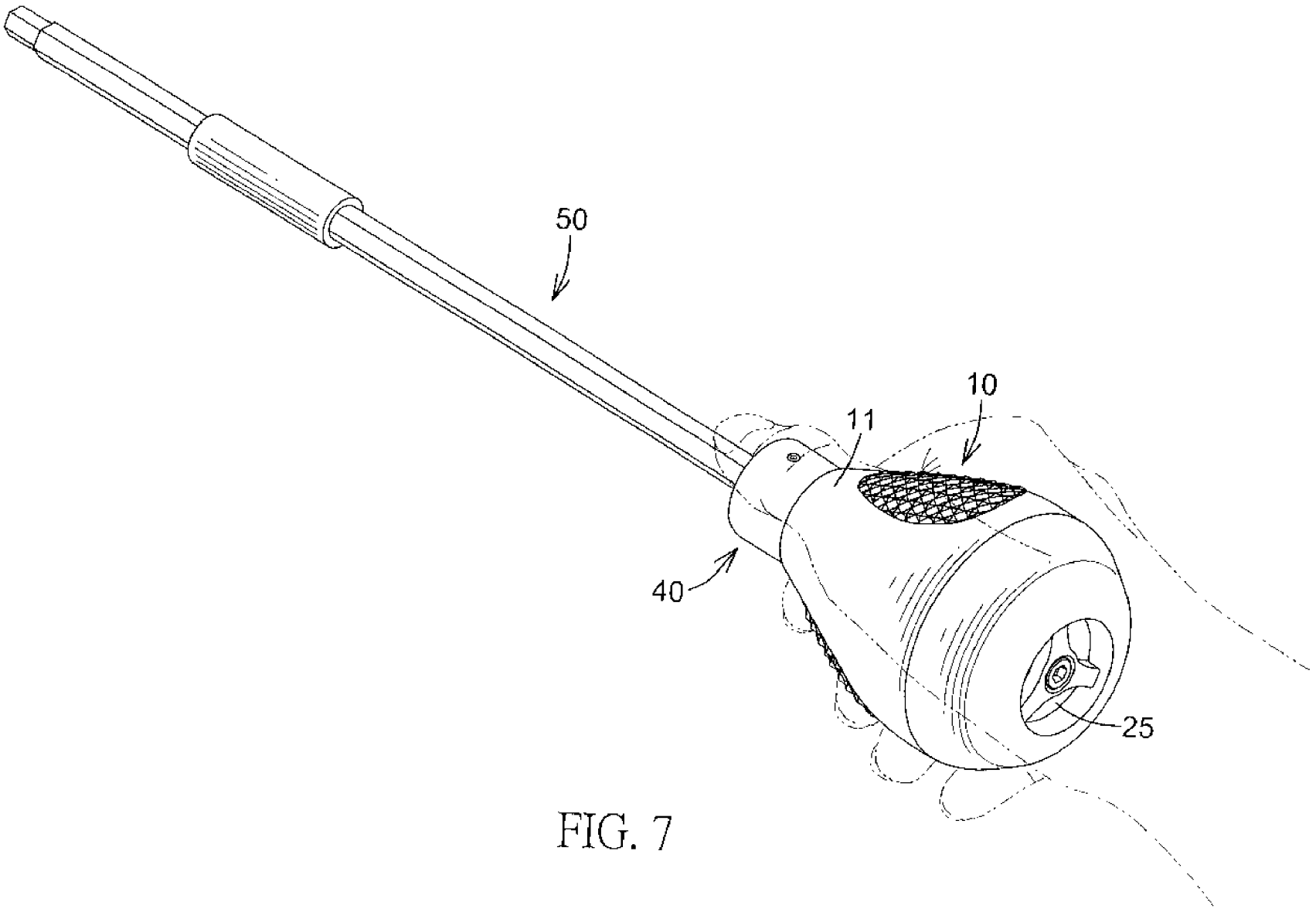
FIG. 7 is an operational perspective view of the ratchet screwdriver in FIG. 1, with a hand shown in phantom lines.

With further reference to FIGS. 4A and 4B and 5, the ratchet (20) is mounted in the receiving chamber (111), may engage with the mounting lip (111) of the body (11) and may comprise a driving sleeve (21), a rotating member (22), a teeth block (23), a heart-shaped spring (24), a drive selector (25) and a connector (26).

The driving sleeve (21) is mounted securely in the receiving chamber (111) and has an inner surface, an outer surface and inner teeth (211). The inner surface is circular. The outer surface corresponds to the receiving chamber (111) and may be hexagonal or hexagonal. The inner teeth (211) are formed on the inner surface of the driving sleeve (21).

The rotating member (22) is mounted in the driving sleeve (21) and has a disc (221), a driving protrusion (222) and a rotating block (223). The disc (221) is mounted in the driving sleeve (21) and has an inner surface and an outer surface. The driving protrusion (222) is formed on and protrudes from the inner surface of the disc (221) and may be quadrangular or have a keyed surface. The rotating block (223) is formed on the outer surface of the disc (221) and has two longitudinal sides, an outer surface, a pivoting surface (2231) and an inserting recess (2232). The pivoting surface (2231) is formed on one longitudinal side of the rotating block (223) and faces the inner teeth (221) of the driving sleeve (21). The inserting recess (2232) is formed on the other longitudinal side of the rotating block (223).

The teeth block (23) is mounted pivotally between the inner teeth (211) of the driving sleeve (21) and the pivoting surface (2231) of the rotating block (223) and has a curved surface, a rotating surface (232), an outer surface, multiple outer teeth (231) and an inserting hole (233). The curved surface corresponds to and engages the inner surface of the driving sleeve (21). The rotating surface (232) is opposite the curved surface and selectively abuts against the pivoting surface (2231) of the rotating block (223). The outer teeth (231) are formed on the curved surface of the teeth block (23), correspond to and selectively engage the inner teeth (211) of the driving sleeve (21). The inserting hole (233) is formed on the outer surface of the teeth block (23).

The heart-shaped spring (24) is mounted on the teeth block (23) and abuts the outer surface of the rotating block (223) and has an inflection and two pivoting protrusions (241). The pivoting protrusions (241) are formed at the inflection and are mounted in the inserting hole (233) of the teeth block (23) to drive the teeth block (23). When the heart-shaped spring (24) is rotated, the teeth block (23) is also turned to engage the driving sleeve (21).

The drive selector (25) is mounted rotatably on the rotating member (22), is connected to the heart shaped spring (24), protrudes out from the receiving chamber (111) and the rear through hole (121) of the cap (12) and has an inner surface and a sliding protrusion (252). The sliding protrusion (252) is formed on the inner surface of the drive selector (25), engages and drives the heart-shaped spring (24) and extends into the inserting recess (2232).

The connector (26) is mounted through the drive selector (25) and is mounted in the rotating block (223) to hold the drive selector (25) rotatably on the rotating member (22).

The shaft (30) is mounted rotatably in the front through hole (112) of the body (11) and securely on the ratchet (20) and has a proximal end (31), a distal end (33) and an outer surface. The proximal end (31) of the shaft (30) is connected to the ratchet (20), maybe to the driving protrusion (222) of the ratchet (20) and may have a keyed recess (311) or correspond to the keyed surface of the driving protrusion (222). The keyed recess (311) is formed in the proximal end of the shaft (30) and corresponds to and engages the ratchet (20), maybe the driving protrusion (222) of the ratchet (20) and may be quadrangular or polygonal. The distal end (33) protrudes out from the front end of the body (11) and has a keyed socket (332), an annular groove (331) and a conical hole (333). The keyed socket (332) is formed axially in the distal end (33) and is polygonal. The annular groove (331) is defined around the distal end (33) and has a bottom. The conical hole (333) is defined through the bottom of the annular groove (331) and communicates with the keyed socket (332) of the shaft (30).

The finger ring (40) is mounted securely around the annular groove (331) of the shaft (30), is smaller than and mounted outside the body (11) and may have an inner surface, a ring groove (41), a threaded hole (42), a bolt (43), a positioning ball (44) and a spring (45). The ring groove (41) is defined in the inner surface of the finger ring (40) and corresponds to the annular groove (331) of the shaft (30). The threaded hole (42) is defined through the finger ring (40). The bolt (43) is mounted through the thread hole (42) and abuts against the annular groove (331) of the shaft (30) so the finger ring (40) is mounted securely around the distal end (33) of the shaft (30). The positioning ball (44) is mounted in the conical hole (333) and protrudes from the keyed socket (332). The spring (45) is mounted between the positioning ball (44) and the ring groove (41) of the finger ring (40) so as to provide a force to the positioning ball (44) to protrude from the keyed socket (332).

The tool (50) is selectively mounted securely in the shaft (30) and has a proximal end (51) and a distal end. The proximal end (51) is mounted in and corresponds to the keyed socket (332) of the shaft (30). The proximal end (51) may be polygonal and may have a mounting groove (52). The mounting groove (52) is defined around the proximal end (51) of the tool (50), corresponds to and selectively engages the positioning ball (44) so the tool (50) can be positioned in the keyed socket (332) of the shaft (30). The distal end may be slotted head, Philips head, a keyed socket head or the like. When the ratchet screwdriver is used to screw different fasteners, the tool (50) can be detached form the keyed socket (332) of the shaft (30) and switched to a corresponding tool (50).

With reference to FIGS. 4A to 7, when the ratchet screwdriver is in use, the distal end of the tool (50) is connected to and rotates a corresponding fastener such as a screw, nut, bolt or the like and the drive selector (25) is rotated to determine a drive direction. Then a user can rotate the body (11) of the handle (10) to tighten or loosen the fastener. When starting off tightening or finishing off loosening, very little torque is required to rotate the fastener, so the user can turn the shaft (30) by rotating the finger ring (40) with their fingers. Because the finger ring (40) is smaller and lighter than the body (11), the finger ring (40) can be spun quickly and efficiently, much faster and easier than rotating the handle (10). Therefore, the handle (10) needs only to be rotated to finish off tightening or start off loosening so saving time, energy and improving comfort of the user.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A ratchet screwdriver comprising a handle comprising a body having a front end;

a rear end;

an inner surface;

a receiving chamber being defined in the body at the rear end; and a front through hole being defined through the body and communicating with the receiving chamber;

a ratchet being mounted securely in the receiving chamber;

a shaft being mounted rotatably in the front through hole of the body and securely on the ratchet and having a proximal end being connected to the ratchet; and a distal end protruding out from the front end of the body and having a polygonal keyed socket formed axially in the distal end;

a finger ring being mounted securely around the distal end of the shaft and being smaller than the body; and a tool being selectively mounted securely in the shaft and having a polygonal proximal end mounted in and corresponding to the keyed socket of the shaft, wherein the distal end of the shaft further has an annular groove being defined around the distal end and having a bottom; and a conical hole being defined through the bottom of the annular groove and communicating with the keyed socket of the shaft; and the finger ring is mounted securely around the annular groove of the shaft and further has an inner surface;

a ring groove being defined in the inner surface of the finger ring and corresponding to the annular groove of the shaft;

a threaded hole being defined through the finger ring;

a bolt being mounted through the threaded hole and abutting against the annular groove of the shaft;

a positioning ball being mounted in the conical hole and protruding from the keyed socket of the shaft; and a spring being mounted between the positioning ball and the ring groove of the finger ring.

2. The ratchet screwdriver as claimed in claim 1, wherein the proximal end of the shaft has a quadrangular keyed recess formed in the proximal end, corresponding to and engaging the ratchet.

3. The ratchet screwdriver as claimed in claim 2, wherein
the body further has a mounting lip being smaller than, formed on and protruding axially from the rear end of the body around the receiving chamber;
the handle further comprises a cap being mounted on the mounting lip of the body and having a rear through hole defined through the cap and communicating with the receiving chamber; and
the ratchet engages the mounting lip of the body.

4. The ratchet screwdriver as claimed in claim 1, wherein
the body further has a mounting lip being smaller than, formed on and protruding axially from the rear end of the body around the receiving chamber;
the handle further comprises a cap being mounted on the mounting lip of the body and having a rear through hole defined through the cap and communicating with the receiving chamber; and
the ratchet engages the mounting lip of the body.

5. The ratchet screwdriver as claimed in claim 3, wherein
the ratchet further has
a driving sleeve being mounted securely in the receiving chamber and having
an inner surface being circular;
an outer surface corresponding to the receiving chamber; and
inner teeth being formed on the inner surface of the driving sleeve;
a rotating member being mounted in the driving sleeve and having
a disc being mounted in the driving sleeve and having an inner surface and an outer surface;
a driving protrusion being formed on and protruding from the inner surface of the disc, corresponding to and being mounting in the keyed recess in the proximal end of the shaft; and
a rotating block being formed on the rear surface of the disc and having
two longitudinal sides;
an outer surface;
a pivoting surface being formed on one of the longitudinal sides of the rotating block and facing the inner teeth of the driving sleeve; and
an inserting recess being formed on the other longitudinal side of the rotating block; and
a teeth block being mounted pivotally between the inner teeth of the driving sleeve and the pivoting surface of the rotating block and having
a curved surface corresponding to and engaging the inner surface of the driving sleeve;
a rotating surface being opposite the curved surface and selectively engaging the pivoting surface of the rotating block;
an outer surface;
outer teeth being formed on the curved surface of the teeth block, corresponding to and selectively engaging the inner teeth of the driving sleeve; and
an inserting hole being formed on the outer surface of the teeth block;
a heart-shaped spring being mounted on the teeth block, abutting the outer surface of the rotating block and having an inflection and two pivoting protrusions being formed at the inflection and mounted in the inserting hole of the teeth block to drive the teeth block;
a drive selector being mounted rotatably on the rotating member, connected to the heart shaped spring, protruding out from the receiving chamber and the rear through hole of the cap and having
an inner surface; and
a sliding protrusion being formed on the inner surface of the drive selector, engaging and driving the heart-shaped spring; and
a connector being mounted through the drive selector and being mounted in the rotating block to hold the drive selector rotatably on the rotating member.

6. The ratchet screwdriver as claimed in claim 1, wherein the keyed socket of the shaft is hexagonal.

* * * * *